US005127806A

United States Patent [19]

Benckert

[11] Patent Number: 5,127,806

[45] Date of Patent: Jul. 7, 1992

[54] THICK MATTER PUMP WITH DOWNSTREAM SHUTOFF DEVICE

[75] Inventor: Hartmut Benckert, Leinfelden-Echterdingen, Fed. Rep. of Germany

[73] Assignee: Putzmeister-Werk Maschinenfabrik GmbH, Aichtal, Fed. Rep. of Germany

[21] Appl. No.: 671,721

[22] PCT Filed: Aug. 3, 1989

[86] PCT No.: PCT/EP89/00912

§ 371 Date: Mar. 29, 1991

§ 102(e) Date: Mar. 29, 1991

[87] PCT Pub. No.: WO90/04102

PCT Pub. Date: Apr. 19, 1990

[30] Foreign Application Priority Data

Oct. 5, 1988 [DE] Fed. Rep. of Germany ..... 3833845

[51] Int. Cl.[5] ..... F04B 49/00; F04B 17/00; F04B 15/02

[52] U.S. Cl. ..... 417/279; 417/343; 417/347; 417/900

[58] Field of Search ..... 417/343, 344, 345, 347, 417/279, 900

[56] References Cited

U.S. PATENT DOCUMENTS

| | | | |
|---|---|---|---|
| 3,981,622 | 9/1976 | Hall et al. | 417/344 |
| 4,030,860 | 6/1977 | Standlick | 417/343 |
| 4,105,373 | 8/1978 | Calzolari | 417/344 |
| 4,490,096 | 12/1984 | Box | 417/344 |

*Primary Examiner*—Richard A. Bertsch
*Assistant Examiner*—Alfred Basichas
*Attorney, Agent, or Firm*—Kenyon & Kenyon

[57] ABSTRACT

A thick matter pump has two feed cylinders, each including an opening coupled in fluid communication with a material feed tank containing matter to be pumped. A tube switch is adapted to be alternately coupled on its intake side to the openings of the feed cylinders, and on its output side to a delivery pipe to permit the passage of pumped matter therethrough and into the delivery pipe. A shutoff device is supported between the output side of the tube switch and the delivery pipe. The shutoff device is adapted to open to permit the passage of pumped matter therethrough and to close to prevent the passage of pumped matter therethrough in accordance with the difference between the pressure on the input side and the pressure on the output side of the shutoff device, which difference is adjustable by hydraulic or pneumatic means.

21 Claims, 1 Drawing Sheet

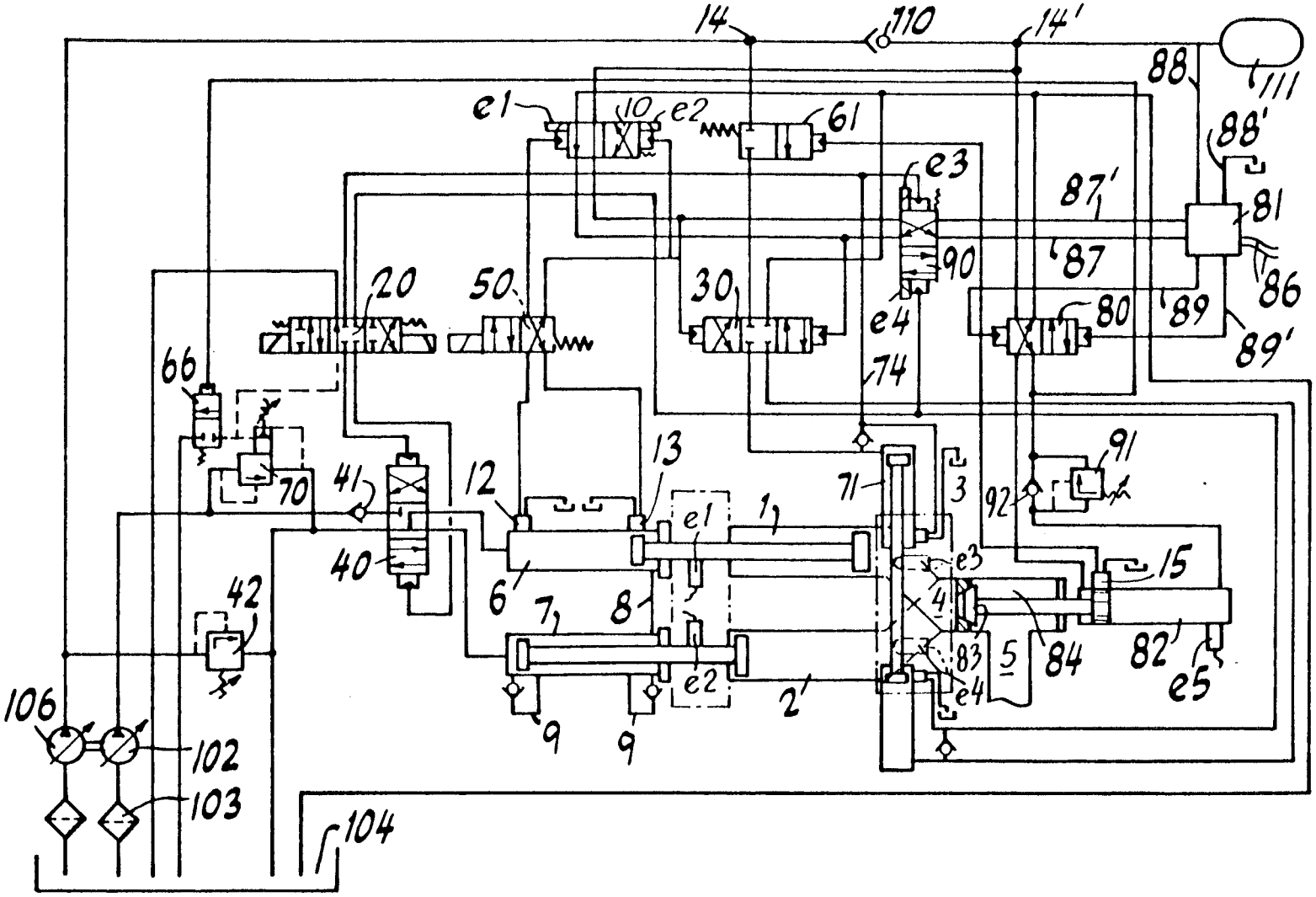
111
88'
81
86
89'
88
89
87'
87
80
91
15
82
e5
14'
92
84
5
110
3
e3
4
83
e4
90
e3
e4
74
71
61
2'
1
14
30
e2
e1
13
8
9
10
e1
50
12
6
7
9
20
41
40
104
70
42
66
102
103
106

THICK MATTER PUMP WITH DOWNSTREAM SHUTOFF DEVICE

The invention relates to a thick matter pump with two feed cylinders which open through front-side openings into a material feed tank and work, in turn, with a tube switch configured inside the material feed tank which is suitable for connection on the intake side alternately to the opening of a feed cylinder and which releases the opening of the other feed cylinder, and is suitable for connection on the output side to a delivery pipe, and with a shutoff device configured in the direction of output flow behind the tube switch.

Pumps of this type are used for conveying concrete and other pasty materials, such as rubble packed with water, as found in tunnel construction, or coal dust packed with water or fuel oil, as used in coal furnaces. The shutoff device in the pressure pipe makes it possible to work against a high pressure without encountering the danger of the material flowing back when the tube switch is reversed. As a tube switch, one should consider above all an S-shaped swing pipe. In general, however, the application of U-shaped swing-pipe tube switches, and Y-shaped (forked) pipe tube switches also lie within the scope of the invention.

Furthermore, it is generally known to provide shutoff devices in the vicinity of the delivery pipe, which can be designed, for example, as seated valves, valve , plates, flap valves, or rotary slide valves.

An object of the invention is to take the necessary precautions to ensure operational reliability of the interlinkage of functional sequences, even when the thick matter pump is conveying compressible media against overpressure.

The solution according to the invention is primarily based on the reflection that the shutoff device must be reversible from its closed position into its open position in accordance with a differential pressure arising between the delivery pipe and the tube switch, and being adjustable by using hydraulic or pneumatic means. The shutoff device should be reversible from the closed position into the open position, above all when a specified pre-compression pressure is reached in the tube switch, preferably exceeding the pressure in the delivery pipe.

According to a preferred embodiment of the invention, the shutoff device is controlled by means of hydraulically or pneumatically operable driving mechanisms. This is preferably accomplished by means of a hydraulic sequencing control in a way which allows the driving mechanisms to be operable in the closing direction of the shutoff device, when a discharge stroke is terminated or reversed in the feed cylinders and before the tube switch is switched over, when there is an unimpeded supply and discharge of pressurized media in the closing direction of the shutoff device, and after the subsequent switching of the tube switch in the opening direction of the shutoff device. Here, an adjustable pressure-keeping device is configured in the pressurized media line for the pressurized media flowing away in the opening direction. To guarantee the unimpeded supply of pressurized media in the closing direction, the pressure-keeping device is effectively bridged over by a back-pressure valve which opens in the direction of inflow. The pressure-keeping device can be designed, for example, as a relief valve or as a pressure-keeping valve. Another improvement in this respect can be attained by mounting an adjustable pressure-keeping device in the pressure-media line, as well, for the pressurized media flowing in the opening direction of the shutoff device.

According to a further preferred embodiment of the invention that provides for one or two tube-switch reversing cylinders and one reversing valve mounted in the hydraulic line leading to these cylinders operable by means of end-position signals from the feed cylinders or their driving cylinders, an additional diverter valve is situated in the hydraulic line leading to the tube-switch reversing cylinders. The diverter valve can be tripped by force in the flow-through direction by means of a signal which is adapted to be tapped off in the blocking position of the shutoff device. When the shutoff device has a hydraulic cylinder as a driving mechanism, preferably a hydraulic or electrical end-position signal, which triggers the additional diverter valve, can be tapped off in the blocking position of the shutoff device at the hydraulic cylinder.

Furthermore, it is advantageous when a reversing valve with hydraulic pilot control is configured in the pressure-media lines leading to the driving mechanisms of the shutoff device, which is controlled together with the tube-switch reversing valve by means of a mutual hydraulic pilot line. In this case, an additional reversing valve, which is operable by means of end-position signals of the tube-switch reversing valve, is mounted in the pilot lines leading to the reversing valve. To obtain the desired sequencing control, a diverter valve, which is controlled by means of the end-position signals from the feed cylinders or their driving cylinders, is mounted in the pilot lines leading to the tube-switch reversing valve and to the shutoff-device reversing valve.

In a preferred exemplified embodiment of the invention, the shutoff device is designed as a seated valve, whose valve seat is configured in the flow route of the pressurized delivery pipe and whose valve disk is configured on the piston rod of a double-acting hydraulic cylinder which constitutes the driving mechanism. In this case, the precompression level can be obtained very simply in that the back-pressure valve opening to the hydraulic cylinder and the pressure-keeping device connected in parallel to this and connected on the input side to the hydraulic cylinder are mounted in the pressure-media line leading to the head-end connection of the hydraulic cylinder.

The driving cylinders actuating the feed cylinders, the tube-switch reversing cylinders, and the driving cylinders for the shutoff device can be pressurized with pressurized media by means of a mutual variable delivery pump, wherein the output volume of the variable delivery pump can be varied in accordance with the operating conditions which are adjustable by means of the sequencing control. The sequencing control can also be achieved in a two-way flow arrangement, in which the driving cylinder for the feed cylinder, on the one hand, and the tube-switch reversing cylinder and driving mechanisms for the shutoff device are controlled with different variable delivery pumps. The sequencing control according to the invention can also be implemented in a free-flow arrangement with the application of reversing pumps.

The invention shall hereinafter be clarified in greater detail based on an exemplified embodiment depicted schematically in the drawing.

The single FIGURE shows a circuit diagram of a sequencing control for a double-cylinder thick matter pump with a downstream shutoff device in two-way flow hydraulics.

The double-cylinder thick matter pump includes two feed cylinders 1,2, whose front-side openings open into a material feed tank 3 and are able to be alternately connected by means of a tube switch 4 to a delivery pipe 5. The feed cylinders 1,2 are actuated by means of hydraulic driving cylinders 6,7 in a push-pull manner. The driving cylinders, in turn, are pressurized with pressure oil at the head end by means of an adjustable hydraulic pump 102 and a reversing valve 40, and are connected to each other hydraulically by means of a cross line 8 at their rod ends. For purposes of stroke correction, a pressure-compensation line 9, which bridges the respective driving piston and contains a back-pressure valve, as shown in the drawing, is mounted at both ends of the driving cylinder 7.

A variable delivery pump 102 draws in pressure oil from a tank 104 through an intake filter 103. A safety valve 70 is provided to safeguard against the high pressure After exiting the safety valve 70, the pressure oil flows through a back-pressure valve 41 into the main slide valve 40, which controls the high pressure to the cylinders 6 and 7 in accordance with the pilot control. In the delivery pipe 5 behind the tube switch, a shutoff device 83, designed in the depicted exemplified embodiment as a seated valve, when closed, blocks the passage into a subsequent discharge zone 84. The shutoff device 83 is driven by a hydraulic cylinder 82. To this end, the shutoff device 83 includes a valve disk mounted on the front end of the projecting part of the piston rod of the hydraulic cylinder 82, as shown in the drawing. In the case of the exemplified embodiment depicted in the drawing, the hydraulic cylinder 82 and reversing cylinders 71,72 of the tube switch are supplied with pressure oil by means of an auxiliary pump 106. One-way flow configurations with only one main oil pump as well as the use of reversing pumps for supplying pressurized media to the individual components are likewise possible, and no substantial changes in the circuit configuration of the sequencing control would result therefrom.

Based on the description of a reversing cycle, the sequencing control is hereinafter described in greater detail:

At the end of a compression stroke of the feed cylinder 1, the piston of the driving cylinder 6 reaches a rodside control valve 13 and releases a hydraulic pulse. The hydraulic pulse is transmitted by means of a diverter valve 50 (found in a spring-centered neutral position) to the pilot control of an electrohydraulically resting diverter valve 10. By way of the connecting points 14 and 14', which are separated from each other by a back-pressure valve 110, the high pressure of the pump 106 reaches the valves 10 and 61. The end-position signal from the control valve 13 causes the valve 10 to be charged with pressure in the position shown in the drawing. In this manner, high pressure attains the pilot control of a tube-switch reversing valve 30 and passes through a valve 90 and control unit 81 for the pilot control of a reversing valve 80. As a result, both the valve 30 as well as the valve 80 are reversed.

Since, however, the diverter valve 61 is still in the spring-centered blocking position, oil pressure is not yet applied to the tube-switch reversing valve 30. The tube switch then remains for the time being in its existing position. Due to the simultaneously reversed valve 80, pressure is applied, on the other hand, to the head end against the hydraulic driving cylinder 82, which is in turn actuated in the closing direction of the shutoff device 83. The inflow of the pressure medium takes place with no restriction through a back-pressure valve 92 opening toward the hydraulic cylinder 82.

In the closed position of the shutoff device 83, the piston of the hydraulic cylinder 82 reaches an additional pilot valve 15, whose output is switched to the pilot control of the valve 61. By activating the valve 61, pressure oil is released starting from the connecting point 14 through the tube-switch reversing valve 30, which was already connected through previously, on to one of the two tube-switch reversing cylinders 71,72. The end positions of the tube switch are tapped off by lines 73 and 74 at the tube-switch reversing cylinders 71,72. From there, the end-position signals are transmitted to the pilot control of the valve 90, which consequently reverses the pilot control of the valve 80, which in turn exerts a rod-side opening pressure on the hydraulic cylinder 82 from the connection point 14'. In addition, the end-position signal is transmitted by lines 73 and 74, via an operating valve 20 to the pilot control of the main slide valve 40. This causes the supply pressure to the driving cylinders 6,7 to reverse. In the clarified example, cylinder 7 is now pressurized at the head end, so that the feed cylinder 2 executes a compression stroke.

The pressurized feed cylinder 2 presses its material through the tube switch 4, toward the shutoff device 83, which is still in the closed position. Due to process-conditional influences, an overpressure can prevail in the vicinity of the discharge zone 84, behind the shutoff device. The shutoff device is to then be opened against this pressure as well. This occurs first as a result of the hydraulic force, which acts at the rod end on the piston of the driving cylinder 82 of the shutoff device and which is adjustable via a relief valve 42. This force is an obstacle to the head-end oil state, which is preloaded by an adjustable relief valve 91. By properly adjusting the relief valves 42 and 91, the force balance acting on the shutoff device 83 can be varied and a desired pre-compression level can be adjusted. The pre-compression guarantees that no return flow emerges out of the overpressurized discharge zone 84 when the shutoff device 83 is opened.

In the end positions of the driving cylinder 6 and during the head-end pressurization of the driving cylinder 82, the valve 66 is tripped by force and the safety valve 70 is opened by means of a signal tap in the supply line leading to the cylinder 82. In this manner, the main flow of oil from pump 102 can run off unhindered to the tank. When the shutoff device 83 is opened, the valve 66 is once again unloaded. A disadvantage of this configuration lies, however, in the fact that during the reversing time, the oil volume from the main pump flows with no usefulness to the tank. However, by taking the right precautions, one can also assure that the main discharge pump 102 is swung back during the reversing time to zero output volume.

The end-position signals applied to the driving cylinders 6,7, to the tube-switch reversing cylinders 71,72, and to the hydraulic cylinder 82 can also be tapped off electrically by means of suitable sensors or proximity switches e1, e2, e3, e4 and e5 and be used to reverse the diverter valves 10 (e1,e2) and 90 (e3,e4), respectively, as well as to control the main oil pump 102 (e5).

Valves 20 and 50 are connected to each other mechanically in an effective manner. The operating modes zero, forward and reverse discharge can be introduced manually at valve 20. In the position "reverse discharge", valve 50 is triggered at the same time. If, as indicated in the drawing, the operating valve 20 is triggered electrically, then valve 50 is also electrically triggered in the position "reverse discharge".

In the normal operation of the system, the control unit 81 is supplied with electrical voltage via connecting terminals 86. The control lines 87 and 89 as well as 87' and 89' are connected under supply voltage. In the off-load state, for example, in the case of an emergency cut-off, one must ensure that the shutoff device 83 is closed by the pressurization of cylinder 82 at the head end. The control unit 81 must therefore connect, without voltage, lines 88 and 89 in an intrinsically safe manner and consequently assure that, independent of the switch position of valve 80 at the time, that cylinder 82 is pressurized with pressure oil at the head end and the shutoff device 83 closes. At the same time, line 89' is then switched to the tank line 88'. An accumulator 111, which is chargeable through pump 106 with pressure oil via the back-pressure valve 110, guarantees that, in an emergency, in case of a failed oil supply, the shutoff device 83 closes on the basis of the oil supply in the accumulator 111.

I claim:

1. A thick matter pump comprising:

two feed cylinders each including an opening coupled in fluid communication with a material feed tank containing matter to be pumped;

a tube switch adapted to be alternately coupled on the intake side thereof to the openings of the feed cylinders and adapted to be coupled on the output side thereof to a delivery pipe to permit the passage of pumped matter from the feed cylinders therethrough and into the delivery pipe; and a shutoff device supported between the output side of the tube switch and the delivery pipe, the shutoff device being adapted to open to permit the passage of pumped matter therethrough and to close to prevent the passage of pumped matter therethrough in accordance with the difference between the pressure on the input side and the pressure on the output side of the shutoff device, which difference is adjustable by fluid means.

2. A thick matter pump as defined in claim 1, wherein the shutoff device is adapted to open to permit the passage of pumped water therethrough when the pressure on the input side thereof reaches a predetermined pressure level.

3. A thick matter pump as defined in claim 2, wherein the predetermined pressure level exceeds the pressure on the output side of the shutoff device.

4. A thick matter pump as defined in claim 2, wherein the fluid means is adapted to close the shutoff device after the termination of the feed stroke of a respective feed cylinder and to then open the shutoff device after the switching of the tube switch to permit the passage of pumped matter therethrough.

5. A thick matter pump as defined in claim 1, wherein the shutoff device is adapted to close after the termination of a feed stroke of a feed cylinder and prior to the switching of the tube switch from the opening of one feed cylinder to the other, and to then open after the switching of the tube switch from the opening of one feed cylinder to the other.

6. A thick matter pump as defined in claim 4, wherein the fluid means includes:

a first driving cylinder; and a first driving piston coupled to the shutoff device and driven within the first driving cylinder in response to the flow of pressurized fluid therein to open and close the shutoff device.

7. A thick matter pump as defined in claim 6, further comprising:

a relief valve coupled to the first driving cylinder and adapted to release pressurized fluid therefrom when the shutoff device is closed in response to the fluid pressure therein exceeding a predetermined pressure level to, in turn, permit the shutoff device to open and, thus, permit the passage of pumped matter therethrough.

8. A thick matter pump as defined in claim 6, further comprising:

a pump coupled to the first driving cylinder and adapted to pump pressurized fluid thereto; and a back-pressure valve coupled between the pump and the first driving cylinder to permit the passage of pressurized fluid from the pump into the first driving cylinder to close the shutoff device.

9. A thick matter pump as defined in claim 6, further comprising:

at least one tube switch cylinder including a tube switch piston driven therein, the tube switch piston being coupled to the tube switch and driven in response to the flow of pressurized fluid in the tube switch cylinder to switch the tube switch; and a tube switch reversing valve coupled to the tube switch cylinder to control the direction of flow of pressurized fluid within the tube switch cylinder.

10. A thick matter pump as defined in claim 9, further comprising:

two second driving cylinders, each adapted to drive one end of a respective second driving piston therein, the other end of each second driving piston being driven within a respective feed cylinder to pump matter in the feed cylinder in response to the flow of pressurized fluid within the respective driving cylinder; and first means for sensing the position of each second driving piston within the respective second driving cylinder and for generating output signals indicative thereof, the tube switch reversing valve being responsive to the output signals to control the operation of the tube switch cylinder and, thus, the tube switch.

11. A thick matter pump as defined in claim 10, further comprising:

second means for sensing the position of the first driving piston within the first driving cylinder and for generating output signals indicative thereof;

a pump coupled to the tube switch reversing valve and adapted to pump pressurized fluid thereto; and a first diverter valve coupled between the pump and the tube switch reversing valve and coupled to the second means, the first diverter valve being responsive to the output signals transmitted by the second means to control the flow of pressurized fluid from the pump to the tube switch reversing valve.

12. A thick matter pump as defined in claim 11, wherein the second means transmits output signals to the first diverter valve upon the first driving piston reaching the position to close the shutoff device and prevent the passage of pumped matter therethrough.

13. A thick matter pump as defined in claim 11, further comprising:

a first reversing valve coupled between the pump and the first driving cylinder to control the flow of pressurized fluid thereto.

14. A thick matter pump as defined in claim 13, further comprising:

third means for generating output signals indicative of the position of the tube switch piston driven within the tube switch cylinder, wherein the first reversing valve is coupled to the first driving cylinder and to the third means and is responsive to the output signals of the third means to control the first driving cylinder and, thus, the shutoff device.

15. A thick matter pump as defined in claim 14, further comprising:

a second diverter valve coupled to the tube which reversing valve and to the first reversing valve, the second diverter valve being responsive to the output signals transmitted by the first means to control the flow of pressurized fluid to the tube switch reversing valve and to the first reversing valve.

16. A thick matter pump as defined in claim 14, further comprising:

a second reversing valve coupled to the tube switch reversing valve to control the flow of pressurized fluid therethrough; and a control unit coupled to the second reversing valve and to the first reversing valve and adapted to control the first reversing valve to permit the passage of pressurized fluid into the first driving cylinder to, in turn, close the shutoff device.

17. A thick matter pump as defined in claim 16, wherein the fluid means includes an accumulator containing pressurized fluid and coupled to the control unit and the first reversing valve, the control unit being adapted to control the accumulator to control the flow of pressurized fluid therefrom, through the first reversing valve and, in turn, into the first driving cylinder to close the shutoff device.

18. A thick matter pump as defined in claim 6, wherein the shutoff device includes a valve disk coupled to the free end of the driving piston and a valve seat supported between the output side of the tube switch and the delivery pipe, the valve disk being adapted to be seated within the valve seat in response to the driving piston being driven toward the tube switch to close the shutoff device.

19. A thick matter pump as defined in claim 10, wherein the first driving cylinder, the tube switch cylinder, and the two second driving cylinders are each coupled to the same pump to receive pressurized fluid therefrom.

20. A thick matter pump as defined in claim 8, further comprising:

a pressure relief valve coupled between the pump and the first driving cylinder and adapted to permit the release of pressurized fluid from the first driving cylinder to facilitate the opening of the shutoff device.

21. A thick matter pump as defined in claim 1, wherein the fluid means is either hydraulic or pneumatic.

* * * * *

UNITED STATES PATENT AND TRADEMARK OFFICE

CERTIFICATE OF CORRECTION

PATENT NO. : 5,127,806

DATED : July 7, 1992

INVENTOR(S) : Benckert, Hartmut

It is certified that error appears in the above-identified patent and that said Letters Patent is hereby corrected as shown below:

Column 5, line 47, change "water" to --matter--;

Column 7, line 16, change "which" to --switch--.

Signed and Sealed this

Eighteenth Day of January, 1994

Bruce Lehman

*Attest:*

BRUCE LEHMAN

*Attesting Officer*

*Commissioner of Patents and Trademarks*